US005387319A

United States Patent [19]

Mora et al.

[11] Patent Number: 5,387,319

[45] Date of Patent: Feb. 7, 1995

[54] PROCESS FOR MANUFACTURING A FLAT, FIBROUS, SUPPLE SUBSTRATE, DIFFICULT TO TEAR AND SUBSTRATE OBTAINED

[75] Inventors: Fernand Mora, Frangy; Claude R. Riou, Menthon St. Bernard, both of France

[73] Assignee: Societe Anonyme: Aussedat-Rey, France

[21] Appl. No.: 32,722

[22] Filed: Mar. 16, 1993

Related U.S. Application Data

[63] Continuation of Ser. No. 523,013, May 14, 1990, abandoned.

[30] Foreign Application Priority Data

May 18, 1989 [FR] France ..... 89 06760

[51] Int. Cl.[6] ..... D21H 13/02

[52] U.S. Cl. ..... 162/146; 162/157.2; 162/157.7

[58] Field of Search ..... 162/20, 21, 28, 145, 162/146, 149, 187, 9, 157.7, 157.3

[56] References Cited

U.S. PATENT DOCUMENTS

| | | | |
|---|---|---|---|
| 2,477,000 | 7/1949 | Osborne | 162/146 |
| 3,028,296 | 4/1962 | Adams | 162/146 |
| 3,032,465 | 5/1962 | Selke | 162/146 |
| 3,039,144 | 10/1974 | Louden | 162/187 |
| 4,483,743 | 11/1984 | Turbak | 162/9 |
| 4,692,211 | 9/1987 | Roberts | 162/187 |
| 5,223,095 | 6/1993 | Kinsley | 162/146 |

FOREIGN PATENT DOCUMENTS

| | | | |
|---|---|---|---|
| 670968 | 1/1966 | Belgium . | |
| 009322 | 4/1980 | European Pat. Off. . | |
| 1055299 | 3/1986 | Japan | 162/146 |
| 3159599 | 7/1988 | Japan | 162/146 |
| 982114 | 2/1965 | United Kingdom . | |
| 1397308 | 6/1975 | United Kingdom | 162/141 |
| 827661 | 5/1981 | U.S.S.R. . | |

OTHER PUBLICATIONS

Battista, O. A., "Synthetic Fibers in Papermaking", Interscience Publishers, N.Y., 1964, pp. 288–291, 13–16.

*Primary Examiner*—W. Gary Jones
*Assistant Examiner*—Brenda Adele Lamb
*Attorney, Agent, or Firm*—Lerner, David, Littenberg, Krumholz & Mentlik

[57] ABSTRACT

This invention relates to a process for manufacturing a flat, fibrous, supple substrate, difficult to tear, said process consisting in:

preparing by fibrillation natural cellulosic fibers until their drainability is greater than 60° Schopper-Riegler, mixing in water a batch of cellulosic fibers thus refined and at least 30% by weight on dry matter of artificial fibers, with respect to the whole quantity of said artificial and cellulosic fibers, diluting the mixture obtained, and producing a substrate sheet from a machine supplied with the mixture.

The invention is more particularly applicable to the manufacture of envelopes and sachets.

8 Claims, No Drawings

PROCESS FOR MANUFACTURING A FLAT, FIBROUS, SUPPLE SUBSTRATE, DIFFICULT TO TEAR AND SUBSTRATE OBTAINED

This is a continuation of application Ser. No. 07/523,013 filed May 14, 1990, now abandoned.

The present invention relates to the manufacture of a flat, fibrous, supple substrate, of the type in web, sheet or film form, and, more particularly, it relates to such supple substrates presenting a good tear strength and a good aptitude to printability.

The invention relates more specifically to such substrates used as paper supports for printing, writing, and even for packaging various products and articles.

By way of particular application, the invention is directed towards flat, fibrous, supple substrates which are difficult to tear, intended for the manufacture of envelopes for packaging, of sachets, bags or the like, geographical maps, printed matter.

Such articles have always been manufactured from sheets of paper, of conventional type or particular type when it is desired to reinforce their strength by their intrinsic quality or by the addition of reinforcements.

The papers have always been manufactured from cellulosic fibers which are more or less refined in order to increase the specific surface and improve the potentiality to create inter-fiber bonds.

The papers are reputed for presenting certain positive characteristics, such as the aptitude to printability and also negative ones, such as the low tear strength and hygroscopic sensitivity.

Although it is possible to improve the moisture resistance by adding specific additives during manufacture of the papers, the conventional manufacturing means have proved not to allow envisaging an increase in the tear strength.

This negative characteristic poses veritable problems in numerous applications, particularly that of the manufacture of envelopes, sachets and bags.

In order to solve this problem, the prior art technique has created a product which is difficult to tear, if not untearable, marketed under the Trademark Tyvek. This product is in the form of a sheet formed from fibers of plastics material deposited on a plane and hot-calendered. The sheet presents a supple character which is effectively difficult to tear, but presents a certain number of drawbacks in addition to its high cost price.

Among these drawbacks, mention must be made of an unaesthetic plastic appearance, considerably difficult printing/writing due to the raw material used and an elastic reaction which poses real problems, for example, for the personnel whose task is to make pre-folds on the sheets for making envelopes, sachets or bags.

These three drawbacks and the high production cost considerably limit the commercial development of such a product, in particular in the application to the production of envelopes, sachets or bags.

The prior art technique has also proposed a solution which consists in producing a paper presenting a better tear strength by incorporating in the conventional cellulosic fibers synthetic fibers selected from polyolefins, polyamides, polyesters, etc. . . The object sought after was to attempt to improve the physical characteristics of the ordinary papers by adding synthetic fibers.

In fact, this technique does not appear to have been truly developed industrially and commercially. This absence of development is probably due to the incorporation of the synthetic fibers which constitute fibers non-binding with respect to the cellulosic fibers conventionally used in the paper-making industry. The presence of these synthetic fibers among the cellulosic fibers is translated by a release of the cellulosic inter-fiber bonds, bringing about a lowering of the conventional physical characteristics, such as the breaking length in accordance with (I) AFNOR NF Q 03-004 or ISO 1924/1-1983 standard; the internal cohesions according to (II) AFNOR NF Q 03-045 standard; the burst according to (III) AFNOR NF Q 03-053 or ISO 2758-1983 standard. Only the tear growth resistance according to (IV) AFNOR NF Q 03-011 or ISO 1974-1974 standard and the non-initiated tear resistance according to (V) TAPPI T 470 os-78 standard seems to have been improved in certain cases up to about 25%.

The tests carried out on the basis of such a technique have demonstrated a threshold of addition close to 20% for the synthetic fibers and the necessity of incorporating different additive products in the mixture with a view to raising the different physical characteristics lowered by the presence of the synthetic fibers. To that end, latex is conventionally incorporated in order to improve the interface cohesion between the natural and synthetic fibers. Such incorporation considerably increases the production costs and does not ensure satisfactory positive rise of the lowered physical characteristics.

Furthermore, in order to improve the overall strength of the absorbent cleaning papers under wet conditions, Patent BE-A-670 968 teaches mixing long, artificial, non-fibrillatable fibers with short fibrillated fibers and adding a binding agent punctually, ensuring the essential of the improvement of the strength. This prior art does not concern a paper which is difficult to tear which presents, in addition, an aptitude to printing/writing. Furthermore, the degree of refining of the cellulosic fibers is extremely low, of the order of 16° SR, which virtually corresponds to a dispersed raw pulp. No teaching useful for obtaining a better tear strength can therefore be retained.

It might have been thought that it sufficed to increase the refining of the pulp to obtain a paper difficult to tear. On the contrary, it is well known in paper-making and in particular, according to PULP and PAPER, Chemistry and Chemical Technology, Vol. II, 1960, Paper making, pages 595–596, that the tear strength decreases with over-refining of the pulp. Similarly, publication FUNDAMENTALS OF PAPER MAKING FIBERS, September 1957, page 387, also notes that increase in refining brings about, at least from a certain limit, a reduction in the tear strength.

It is an object of the present invention to overcome the drawbacks of the prior art set forth hereinabove, by proposing a novel process for manufacturing a flat, fibrous, supple substrate which is difficult to tear, more particularly but not exclusively intended for making envelopes, sachets, bags or the like.

Another object is to produce, at an interesting cost price, a flat, fibrous, supple substrate difficult to tear, which in addition presents a good aptitude to printing/-writing, as well as an increased resistance to the variations in ambient hygrometry.

A further object of the invention is to propose a novel substrate presenting a good aptitude to folding, in order to facilitate manufacture of envelopes, sachets, bags or the like.

To attain the objects set forth hereinabove, the manufacturing process according to the invention consists in:

preparing by fibrillation natural cellulosic fibers until their drainability is greater than 60° Schopper-Riegler, mixing in water a batch of cellulosic fibers thus refined and at least 30% by weight on dry matter with respect to the whole of said natural cellulosic and artificial fibers, with respect to the whole quantity of said artificial and cellulosic fibers, pouring the mixture obtained in a headbox of a paper-making machine, and producing a substrate sheet from said machine supplied with the mixture and whose operation respects the conventional operational parameters.

By way of novel industrial product, the invention also relates to a flat, supple, fibrous substrate, difficult to tear, characterized in that it comprises natural cellulosic fibers refined by fibrillation until a drainability close to 60° Schopper-Riegler is attained, and artificial fibers mixed at a rate of at least 30% by weight on dry matter of the whole quantity of said artificial cellulosic fibers.

The process according to the invention consists firstly in preparing cellulosic fibers, preferably of the same species or plant varieties. The cellulosic fibers from deciduous trees or ligneous Graminaceae are preferred, although good results can also be obtained with fibers from conifers.

Cellulosic fibers should be considered as the paper-making pulps conventionally produced for manufacturing papers. The preparation of such a pulp according to the invention consists in refining the fibers by fibrillation so as to give them a drainability greater than 60 and preferably greater than 80° Schopper-Riegler. Such drainability may be assessed by applying the conditions of the AFNOR NF Q 50-003 or ISO 5267/1 -1979 standard.

The desired object is to micro-fibrillate the cellulosic fibers so as to increase the specific surface thereof to improve the aptitude to create hydrogen bonds.

A mixture is then prepared by incorporating in the paper-making pulp, over-refined with respect to the ordinary treatment of conventional paper pulp, a quantity of artificial fibers at least equal to 30% by weight on dry matter of the whole quantity of said artificial and cellulosic fibers. Artificial fibers should be considered as any non-natural fibers, such as plastics, regenerated fibers, etc. . .

Mixture is effected in an aqueous medium in accordance with the conventional conditions in paper-making techniques, for example at a rate of 2 to 4% by weight of cellulosic and artificial fibers.

The artificial fibers used may belong to one or more families and, preferably, to that of the polyolefins, polyamides and polyesters for the plastic fibers, and to the viscose or acetate of cellulose for the regenerated ones. Fibers of polyethylene terephthalate are particularly suitable for the plastic family.

According to the invention, the artificial fibers incorporated are in the form of segments of determined length greater than or equal to 3 mm and preferably included between 4 and 12. The fibers selected are at the most equal to 10 decitex and preferably between 1.1 and 2 decitex.

According to the invention, the quantity of artificial fibers employed is included between 30 and 70% and is preferably equal to 50% or the range of 50 to 70% by weight on dry matter with respect to the whole quantity of said artificial and cellulosic fibers.

Mixture between the cellulosic fibers and the artificial fibers in an aqueous medium is effected with the possible addition of additives which subsequently improve opacity, hydrophoby or insensitivity to water or moisture. The additives used to that end may be considered as products known for these functions in the domain of paper-making pulps and, strictly speaking, do not form part of the invention as incorporation thereof in the mixture, despite the presence of artificial fibers, comes directly within the scope of the man skilled in the art.

The mixture obtained, after homogenization under conventional conditions, is diluted in water between 0.2 and 0.4%, then is poured into the headbox of a paper-making machine so as to be delivered in conventional manner on the wire cloth from which a sheet may be produced in accordance with conventional conditions. Such conditions include draining, drying, sizing and calendering further to which the sheet substrate produced may be stored on a reel or possibly pre-cutout in a ream of predetermined format.

An example of composition will be given herein-after to compare the improvements in performances of the substrate according to the invention with respect to an ordinary paper and a substrate of the Tyvek type.

EXAMPLE 1

The substrate according to the invention is for example produced from a mixture of paper-making pulp coming from a plant variety Eucalyptus sp. Such a pulp is over-refined by fibrillation until it presents a drainability equal to 95° SR.

A mixture is made in an aqueous medium, by incorporating fibers at a concentration of 3% by weight, these fibers including 50% of cellulosic fibers and 50% of artificial fibers of the polyester family, 6 mm in length and of 1.7 decitex. This mixture is then diluted to 0.45% in the headbox to produce a substrate with a G.S.M. of 90 g/m$^2$.

The following Table will show the different comparable characteristics between a paper 1 of conventional type, a substrate 2 of Tyvek type and a substrate 3 according to the invention.

| | 1 | 2 | 3 |
|---|---|---|---|
| STANDARD (I) in Km | 5.8 | 9.4 | 4.2 |
| STANDARD (II) in SCOTT | 250.0 | 66.0 | 350.0 |
| STANDARD (III) in KPa | 3.3 | 14.0 | 5.1 |
| STANDARD (IV) in mN | 765.0 | 5680.0 | 3250.0 |
| STANDARD (V) in KN/m | 0.9 | 16.7 | 6.5 |

The values indicated are reduced to a G.S.M. of 100 g/m$^2$.

EXAMPLE 2

The substrate according to the invention is the same as in the preceding Example, except that the artificial fibers are entirely constituted by viscose.

| | 1. | 2 | 3 |
|---|---|---|---|
| STANDARD (I) in Km | 5.8 | 9.4 | 4.7 |
| STANDARD (II) in SCOTT | 250.0 | 66.0 | 160.0 |

-continued

| | 1. | 2 | 3 |
|---|---|---|---|
| STANDARD (III) in KPa | 3.3 | 14.0 | 4.3 |
| STANDARD (IV) in mN | 765.0 | 5680.0 | 1960.0 |
| STANDARD (V) in KN/m | 0.9 | 16.7 | 1.2 |

The values given are reduced to a G.S.M. of 100 g/m$^2$.

It should be noted that the substrate according to Example 2 presents the further advantage of being totally biodegradable.

The invention is not limited to the Examples described and shown, as various modifications may be made without departing from the scope thereof.

What is claimed is:

1. A process for manufacturing a flat, fibrous, supple substrate having improved tear-resistance comprising preparing natural cellulosic fibers by fibrillation to a sufficient extent to a obtain a drainability greater than about 80° Schopper-Riegler, mixing said fibrillated natural cellulosic fibers in water with artificial fibers including one or more ingredients selected from the group consisting of polyolefins, polyamides, polyesters, viscose and acetate of cellulose, said mixture comprises an amount of said artificial fibers ranging from 50% to 70% by weight on dry matter with respect to the whole of said natural cellulosic and artificial fibers, providing said mixture of fibrillated natural cellulosic fibers and artificial fibers in a head box for a paper-making machine, and flowing said mixture from said head box and onto a paper-making machine to produce said substrate.

2. The process of claim 1 wherein said artificial fibers are from about 1 to 10 decitex.

3. The process of claim 1 wherein said artificial fibers have a length of at least about 3 mm.

4. The process of claim 3 wherein said artificial fibers have a length of between about 4 and 12 mm.

5. A flat, fibrous, supple substrate having improved tear-resistance comprising natural cellulosic fibers which have been refined by means of fibrillation to have a drainability of at least 80° Schopper-Riegler and artificial fibers including one or more ingredients selected from the group consisting of polyolefins, polyamides, polyesters, viscose and acetate of cellulose, said artificial fibers being present in an amount ranging from about 50% to 70% by weight on dry matter with respect to the whole of said cellulosic and artificial fibers.

6. The substrate of claim 5 wherein said artificial fibers are from about 1 to 10 decitex.

7. The substrate of claim 5 wherein said artificial fibers have a length of at least about 3 mm.

8. The substrate of claim 7 wherein said artificial fibers have a length of between about 4 and 12 mm.

* * * * *

UNITED STATES PATENT AND TRADEMARK OFFICE

CERTIFICATE OF CORRECTION

PATENT NO. : 5,387,319
DATED : February 7, 1995
INVENTOR(S) : Mora et al.

It is certified that error appears in the above-indentified patent and that said Letters Patent is hereby corrected as shown below:

Cover Page, [54], "PROCESS FOR MANUFACTURING A FLAT, FIBROUS, SUPPLE SUBSTRATE, DIFFICULT TO TEAR AND SUBSTRATE OBTAINED" should read --PROCESS FOR MANUFACTURING AN IMPROVED PAPER-LIKE SUBSTRATE AND PRODUCT OBTAINED THEREFROM--.

Cover Page, [57] ABSTRACT, Line 3, "consisting in:" should read --comprising:--.

Cover Page, [57] ABSTRACT, line 7, cancel the words "mixing in water a batch of cellulosic fibers thus refined and at least 30% by weight on dry matter of artificial fibers, with respect to the whole quantity of said artificial and cellulosic fibers."

Cover Page, [57] ABSTRACT, line 14, cancel the words "the invention is more particularly applicable to the manufacture of envelopes and sachets."

Column 3, line 22, "artificial cellulosic" should read --natural cellulosic and artificial--.

Column 3, line 46, "artificial and cellulosic" should read --natural cellulosic and artificial--.

Column 4, line 1, cancel the word "quantity".

Column 6, line 19, cancel the word "about".

Signed and Sealed this

Fifth Day of September, 1995

Bruce Lehman

*Attest:*

BRUCE LEHMAN

*Attesting Officer*

*Commissioner of Patents and Trademarks*